United States Patent [19]

Adams, Jr.

[11] 4,431,051

[45] Feb. 14, 1984

[54] SURFACE CONTROLLED SUBSURFACE SAFETY VALVE

[75] Inventor: James B. Adams, Jr., Lewisville, Tex.

[73] Assignee: Otis Engineering Corporation, Dallas, Tex.

[21] Appl. No.: 323,119

[22] Filed: Nov. 19, 1981

[51] Int. Cl.[3] ..... E21B 34/10

[52] U.S. Cl. ..... 166/72; 166/324; 166/375; 251/28

[58] Field of Search ..... 166/72, 319, 321, 322, 166/324, 325, 332; 251/25, 28

[56] References Cited

U.S. PATENT DOCUMENTS

| | | | |
|---|---|---|---|
| 2,805,038 | 9/1957 | Towler et al. | 251/28 |
| 3,000,607 | 9/1961 | Bauerlein | 251/28 |
| 3,208,531 | 9/1965 | Tamplen | 166/125 |
| 3,292,706 | 12/1966 | Grimmer et al. | 166/322 |
| 3,583,442 | 6/1971 | Dollison | 137/630.19 |
| 3,826,462 | 7/1974 | Taylor | 251/58 |
| 3,860,066 | 1/1975 | Pearce et al. | 116/72 |
| 4,005,751 | 2/1977 | Page, Jr. | 166/321 |
| 4,119,146 | 10/1978 | Taylor | 166/72 |
| 4,143,850 | 3/1979 | Brakebill | 251/28 |
| 4,173,256 | 11/1979 | Kilgore | 166/324 |
| 4,325,409 | 4/1982 | Roberts | 166/72 |

*Primary Examiner*—William F. Pate, III
*Assistant Examiner*—William P. Neuder
*Attorney, Agent, or Firm*—Thomas R. Felger

[57] ABSTRACT

A surface controlled subsurface safety valve for deep well service. Communication of control fluid to the subsurface safety valve is controlled by a pilot valve at a subsurface location in close proximity to the safety valve. Responsiveness of the subsurface safety valve to decrease in control fluid pressure is thereby increased and the safety valve's closure speed is also increased. The pilot valve controllably communicates pressurized control fluid to open the safety valve and allows control fluid to be displaced into the flow path through the safety valve during valve closure.

15 Claims, 17 Drawing Figures

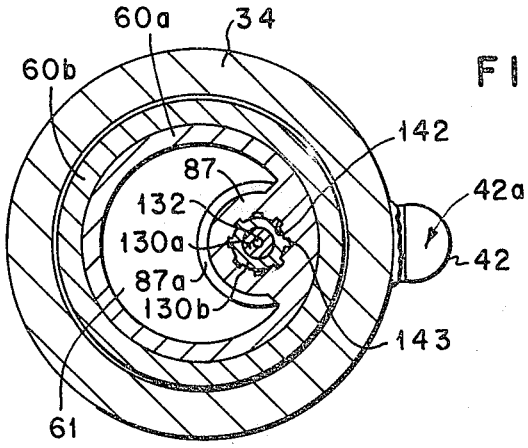
FIG. 3
FIG. 4A
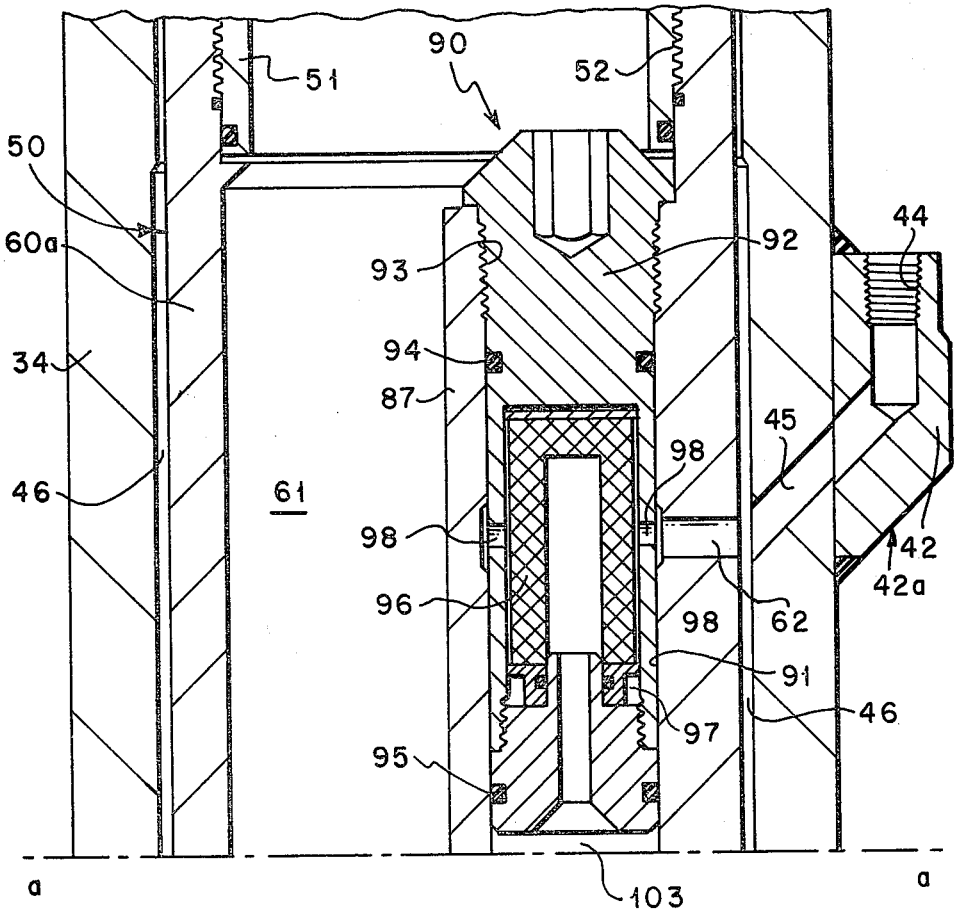

SURFACE CONTROLLED SUBSURFACE SAFETY VALVE

BACKGROUND OF THE INVENTION

1. Field of the Invention

This invention relates to surface controlled subsurface safety valves for controlling fluid flow within a well. The invention also relates to a pilot valve for communicating control fluid to the safety valve from the well surface.

2. Prior Art

A common limitation of conventional surface controlled subsurface safety valves is the volume of control fluid which must be displaced from the valve's control chamber to permit valve closure. Preferably, safety valves are designed to close when control fluid pressure drops below a preselected value. Thus, damage to the wellhead and/or control system should result in closure of the safety valve at its downhole location. For conventional safety valves operated by a single control fluid conduit from the well surface, various fluid forces resist valve closures. These forces include the hydrostatic pressure of fluid in the conduit, inertia of fluid in both the conduit and the control chamber of the safety valve, and friction forces developed between the control fluid and the interior of the conduit.

U.S. Pat. No. 4,119,146 to Frank H. Taylor and U.S. Pat. No. 4,173,256 to Marion D. Kilgore disclose pilot operated subsurface safety valves with improved response time for closure of the respective safety valves. Both patents are incorporated by reference for all purposes within this application.

SUMMARY OF THE INVENTION

The present invention discloses a surface controlled subsurface safety valve comprising safety valve housing means with a fluid flow path therethrough; valve closure means associated with the safety valve housing means and adapted for movement between a first position opening the flow path and a second position closing the flow path; control chamber means adapted to receive control fluid from the well surface and to shift the valve closure means from its second position to its first position when the pressure of fluid within the control chamber is greater than a preselected value; resilient means for urging the valve closure means to shift from its first position to its second position when the pressure of fluid within the control chamber is less than a preselected value; a pilot valve means having a first position allowing communication of control fluid from the well surface to the control chamber when the pressure of control fluid within the pilot valve exceeds a preselected value and blocking fluid communication between the control chamber and the flow path; the pilot valve means having a second position blocking communication of control fluid from the well surface with the control chamber and allowing fluid within the control chamber to communicate with the flow path; the pilot valve means comprising a first valve means and second valve means; means for biasing the first valve means towards its first position allowing communication of fluids between the control chamber and the flow path; means for biasing the second valve means towards its first position blocking communication of control fluid from the well surface through the pilot valve means to the control chamber; control fluid pressure above a preselected value shifting the first valve means to its second position blocking control fluid communication with the flow path and shifting the second valve means to its second position allowing control fluid to communicate with this control chamber; and the biasing means for the first valve means selected to yield at a control fluid pressure lower than the pressure at which the biasing means for the second valve means will yield.

One object of this invention is to provide a surface controlled subsurface safety valve that closes without requiring displacement of fluid from the valve's control chamber against fluid forces due to the presence of control fluid in a control conduit means.

Another object of this invention is to substantially increase the depth limitations for installation of surface controlled subsurface safety valves.

Still another object of this invention is to provide a surface controlled subsurface safety valve having a control chamber that displaces control fluid into the flow path during valve closure and does not require the displacement of fluid from the chamber into the control conduit means.

A further object of this invention is to provide a surface controlled subsurface safety valve that can close more quickly than present surface controlled subsurface safety valves.

A still further object of this invention is to provide a surface controlled subsurface safety valve wherein the valve's control chamber is substantially pressure balanced with the pressure of fluids flowing through the valve via a pilot valve means to enable valve closure more quickly than can be obtained for present surface controlled subsurface safety valves.

Another object of the invention is to provide a pilot valve that controls communication of fluid between the well surface and a subsurface safety valve.

These and other objects and advantages of the present invention will be apparent to those skilled in the art from studying the drawings, detailed description and claims.

BRIEF DESCRIPTION OF THE DRAWINGS

FIG. 3 is a drawing taken along lines 3—3 of FIG. 2B.

FIGS. 4A–E are drawings in longitudinal section with portions broken away showing the safety valve of FIGS. 2A–D in its first position with the valve closure means open.

DETAILED DESCRIPTION OF THE PREFERRED EMBODIMENT

Figure 1:
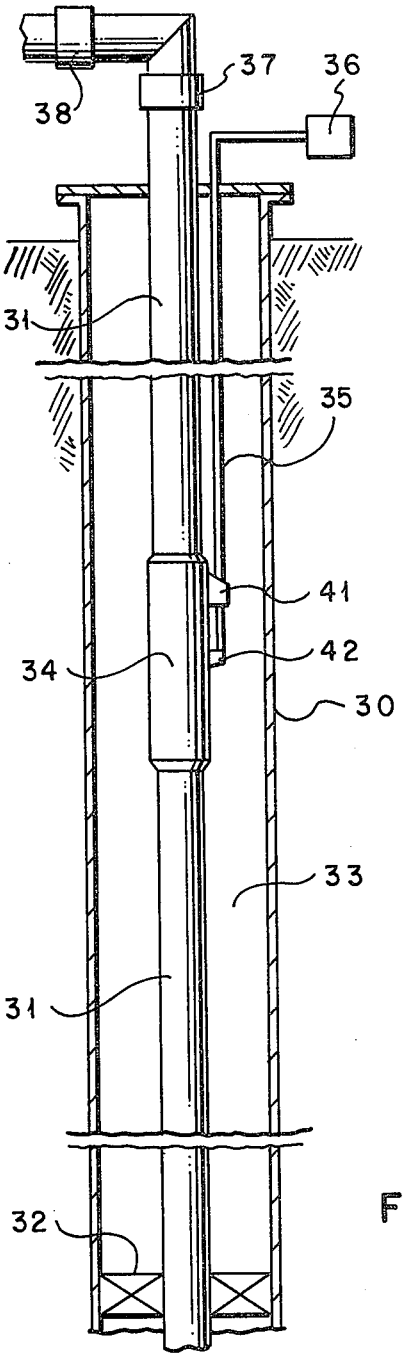
FIG. 1 is a schematic drawing of a well installation having a surface controlled subsurface safety valve incorporating the present invention.
Figure 5:
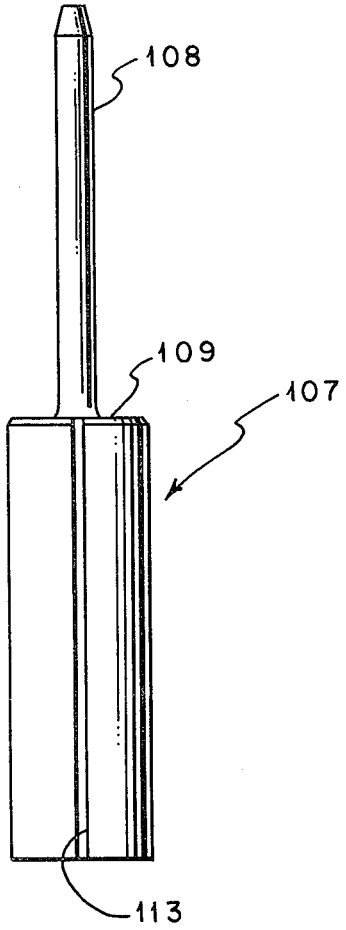
FIG. 5 is a drawing in elevation of the hollow sleeve which comprises part of the second valve means within the pilot valve means.

FIG. 1 shows a typical well installation for using the present invention. The well bore is defined by casing string 30 which extends from a hydrocarbon producing formation (not shown) to the well surface. A well flow conductor, such as tubing string 31, is disposed within casing string 30 to conduct hydrocarbon flow to the well surface. Annulus 33 is formed between the exterior of tubing string 31 and the interior of casing string 30. Production packer 32 is preferably located immediately above the producing formation to seal off annulus 33 and to direct formation fluid flow to the well surface through tubing string 31.

Tubing string 31 includes landing nipple 34. A surface controlled subsurface safety valve can be installed by conventional wireline techniques within landing nipple 34 to control formation fluid flow through tubing string 31. Control conduit means 35 extends from the well surface to nipple 34. As will be explained in more detail, hydraulic control fluid can be directed through conduit means 35 to operate a safety valve disposed within nipple 34. Manifold 36 including associated hydraulic pumps and accumulators (not shown) supplies control fluid to conduit means 35. At the well surface, valves 37 and 38 control fluid flow from tubing string 31.

FIGS. 2A–D show, in detail, landing nipple 34 with surface controlled subsurface safety valve 50 secured therein. Safety valve 50 is designed so that when the pressure of control fluid within conduit means 35 exceeds a preselected value, safety valve 50 will open allowing fluid communication through tubing string 31. When control fluid pressure within conduit means 35 decreases below a preselected value, safety valve 50 will close blocking fluid communication through tubing string 31.

Threads 39 and 40 are formed on opposite ends of landing nipple 34 for use in making up nipple 34 as part of tubing string 31. First boss 41 and second boss 42 are attached to the exterior of nipple 34 for use in attaching control conduit 35 thereto. Boss 41 has opening 43 extending therethrough and sized to receive conduit 35. Boss 42 has threaded opening 44 which communicates via passageway 45 to bore 46 within the interior of nipple 34. Conduit 35 can be inserted through opening 43 and threadedly engaged with opening 44 to communicate control fluid from the well surface to bore 46. Bore 46 extends longitudinally through nipple 34 and includes annular locking grooves or profile 47 formed in its inside diameter for securing safety valve 50 therein.

Safety valve 50 is attached by threaded connection 52 to locking mandrel 51. Locking mandrel 51 carries dogs 53 which can be radially expanded to engage profile 47. U.S. Pat. No. 3,208,531 to J. W. Tamplen discloses landing nipples and locking mandrels satisfactory for use with safety valve 50, U.S. Pat. No. 3,208,531 is incorporated by reference for all purposes within this application. Safety valve 50 is further defined by housing means 60 which has five major housing subassemblies 60*a* through 60*e*. Each subassembly is generally cylindrical with a hollow bore therethrough. The subassemblies are threadedly connected to each other with their respective hollow bores aligned to define fluid flow path 61 through safety valve 50 and locking mandrel 51.

Sealing means 54 are carried on the exterior of locking mandrel 51 between dogs 53 and threads 52. Similar sealing means 55 are carried on the exterior of housing subassembly 60*a*. Sealing means 54 and 55 form a fluid tight seal with the inside diameter of nipple 34 adjacent thereto. They are also spaced longitudinally from each other so that when dogs 53 are engaged with profile 47, control fluid from passageway 45 will communicate with only the portion of bore 46 between sealing means 54 and 55. The sealing means cooperate to block formation fluids from communicating with control fluid. Also, sealing means 55 direct formation fluid flow through safety valve 50 via flow path 61. As will be explained later in more detail, pilot valve means 90 is carried on the inside diameter of housing subassembly 60*a*. Lateral port or passageway 62 extends through the wall of housing subassembly 60*a* and allows control fluid communication between pilot valve means 90 and conduit 35 via opening 44 and bore 46.

Figure 2A:
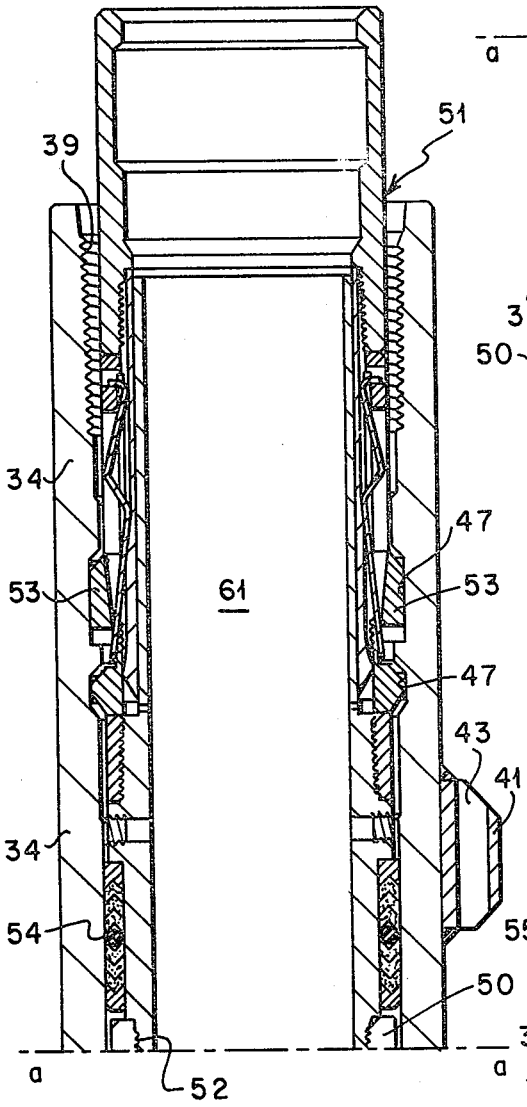
FIGS. 2A–D are drawings in longitudinal section showing a safety valve in its second position with the valve closure means shut, and a pilot valve means for controlling the safety valve.
Figure 2B:
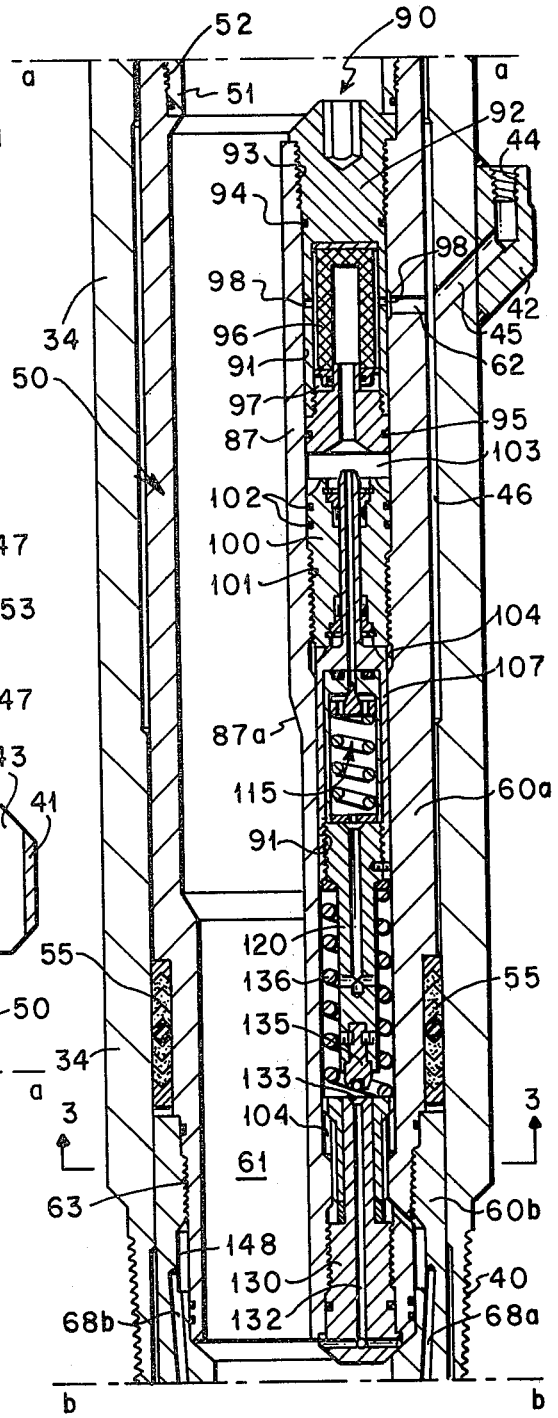
Figure 2C:
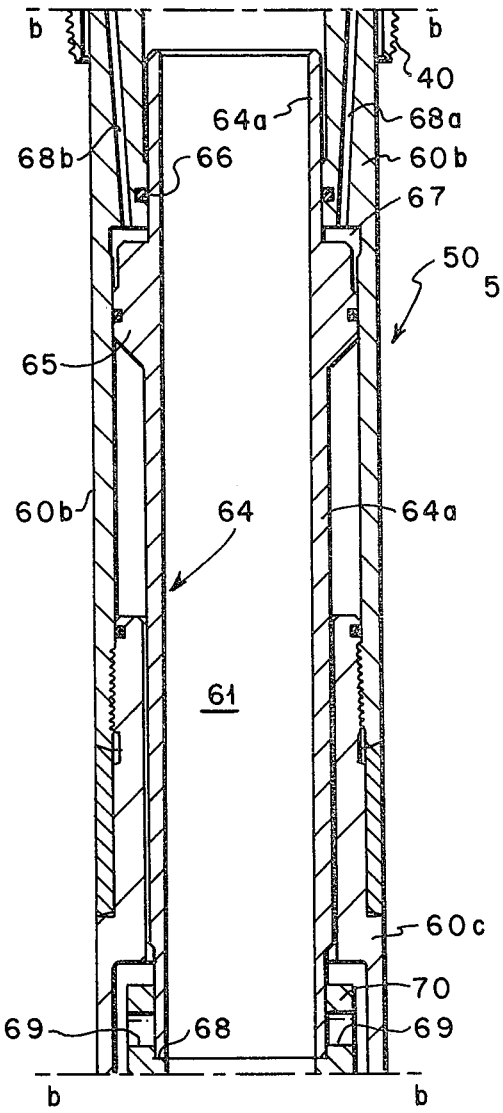

Housing subassembly 60*b* is engaged by threads 63 to subassembly 60*a*. As best shown in FIG. 2C, operating sleeve 64 and its piston means 65 are slidably disposed within housing subassembly 60*b*. Operating sleeve 64 has a bore therethrough which defines a portion of flow path 61. Stationary seal or o-ring 66 is carried on the inside diameter of housing subassembly 60*b* and forms a fluid tight barrier with the exterior of sleeve 64 spaced longitudinally from piston means 65. Variable volume control fluid chamber 67 is partially defined by stationary seal 66 and piston means 65. Drilled passageways 68*a* and 68*b* extend longitudinally for a limited distance through the wall of subassembly 60*b* and communicate control fluid between control chamber 67 and pilot valve means 90.

For ease of manufacture, operating sleeve 64 consists of two cylinders 64*a* and 64*b* concentrically aligned and abutting each other at shoulder 68 within end 70 of cylinder 64*b*. Holes 69 are provided within end 70 for handling cylinder 64*b* during assembly. End 70 has an enlarged inside diameter to receive cylinder 64*a* therein. End 70 also has an enlarged outside diameter as compared to the remainder of cylinder 64*b*. This enlargement of end 70 provides an external shoulder 71 for engagement with resilient means 72. Housing subassembly 60*c* surrounds resilient means 72 and the major portion of cylinder 64*b*. Housing subassembly 60*d*, which is threadedly engaged with subassembly 60*c*, provides shoulder 73 on the interior of subassembly 60*c*. Resilient means 72 is disposed between shoulders 71 and 73 and surrounds the exterior of operating sleeve 64. Resilient means 72 opposes the forces acting on operating sleeve 64 caused by control fluid pressure within chamber 67.

Ball 76 with bore 81 therethrough is rotatably and slidably disposed within housing subassembly 60*e*. Support means 77 is secured within flow passageway 61 between housing subassemblies 60*d* and 60*e*. Ball 76 is connected by an off-center pivot (not shown) to support means 77. Ball valve seat means 75 is attached to a pair of rotating arms 79 which are engaged to ball 76 by pivot pins 78. Operating sleeve 64 is engaged by threads 74 to ball valve seat means 75. Thus, longitudinal movement of operating sleeve 64 relative to housing means 60 causes rotation of ball 76 and longitudinal movement of ball 76 within housing subassembly 60*e*. Ball valve seat means 75 is generally cylindrical with sealing surface 80 having a radius to match the exterior of ball 76. Surface 80 is preferably formed from a hard metal to maintain sealing contact with the exterior of ball 76. When ball 76 is rotated so that its bore 81 is normal to flow path 61, ball 76 and sealing surface 80 cooperate to prevent fluid flow through safety valve 50.

Ball valve seat means 75 also carries an annular seal 82 which contacts a matching seal 83 on the interior of housing subassembly **60*d* adjacent thereto. Preferably, either seal 82 or 83 will be formed from elastomeric material, and the other seal will be formed from hardened metal. Seals 82 and 83 plus port 84 cooperate to provide safety valve 50 with means for equalizing fluid pressure across ball 76**.

When operating sleeve 64 moves longitudinally, seals 82 and 83 disengage before ball 76 starts to rotate. When seals 82 and 83 are no longer in contact, formation fluids can bypass ball 76 and enter flow path 61 above ball 76 through ports 84. This feature allows any pressure difference across ball 76 and seating surface 80 to equalize before rotating ball 76 to align bore 81 with flow path 61.

Figure 2D:
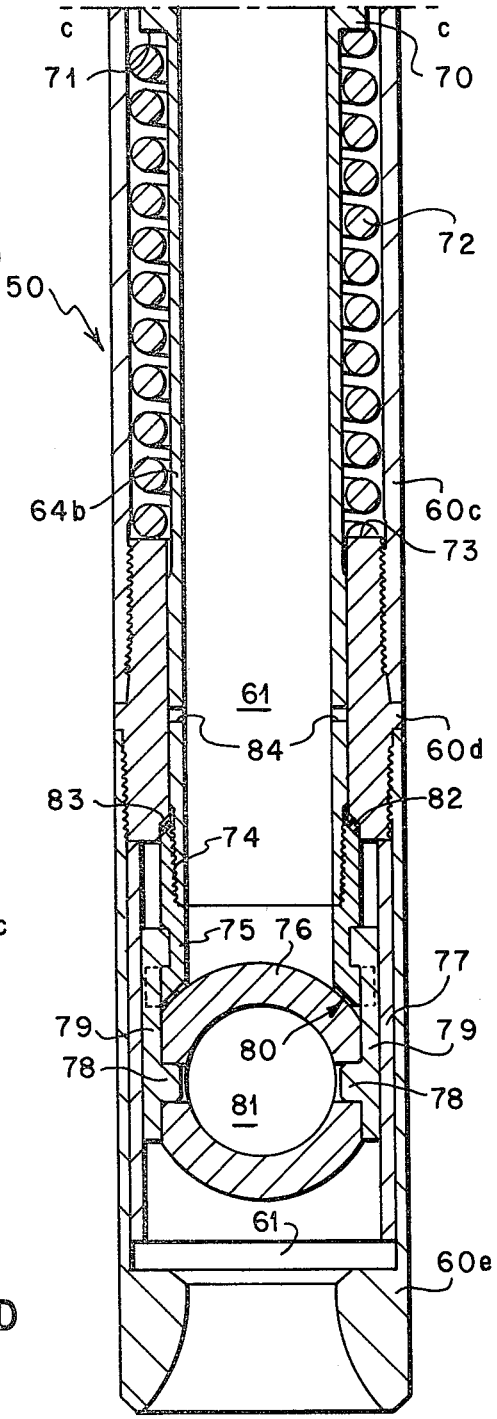
Figure 4B:
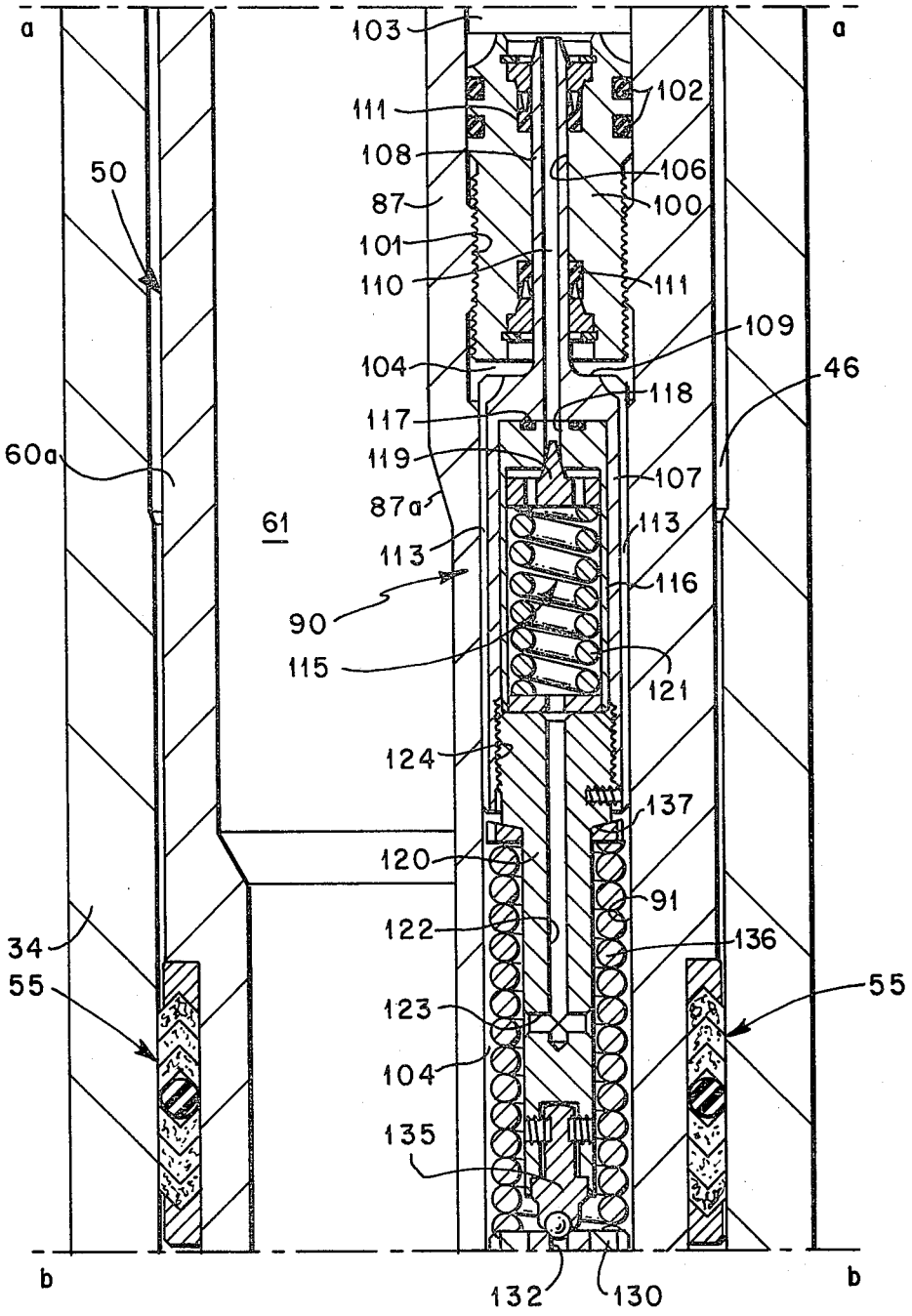
Figure 4C:
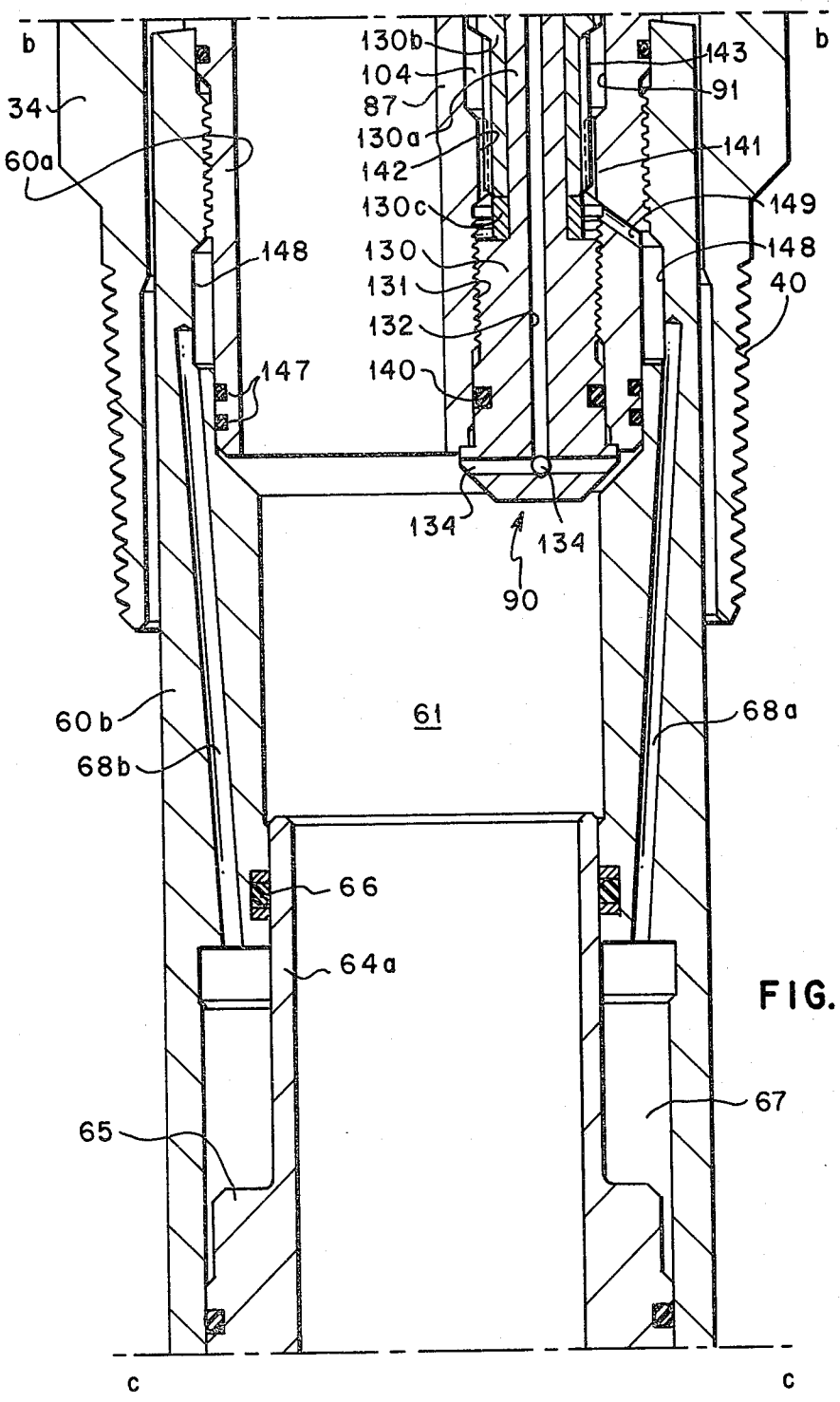
Figure 4D:
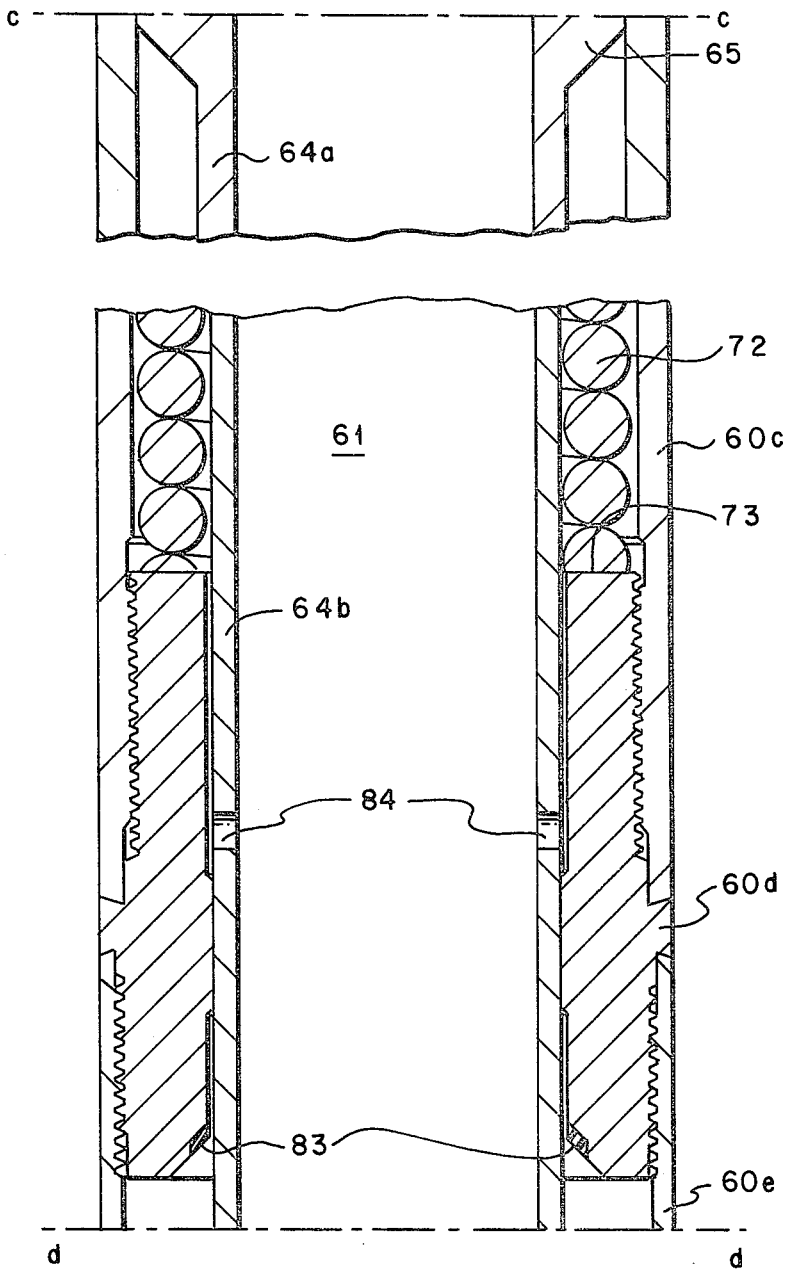
Figure 4E:
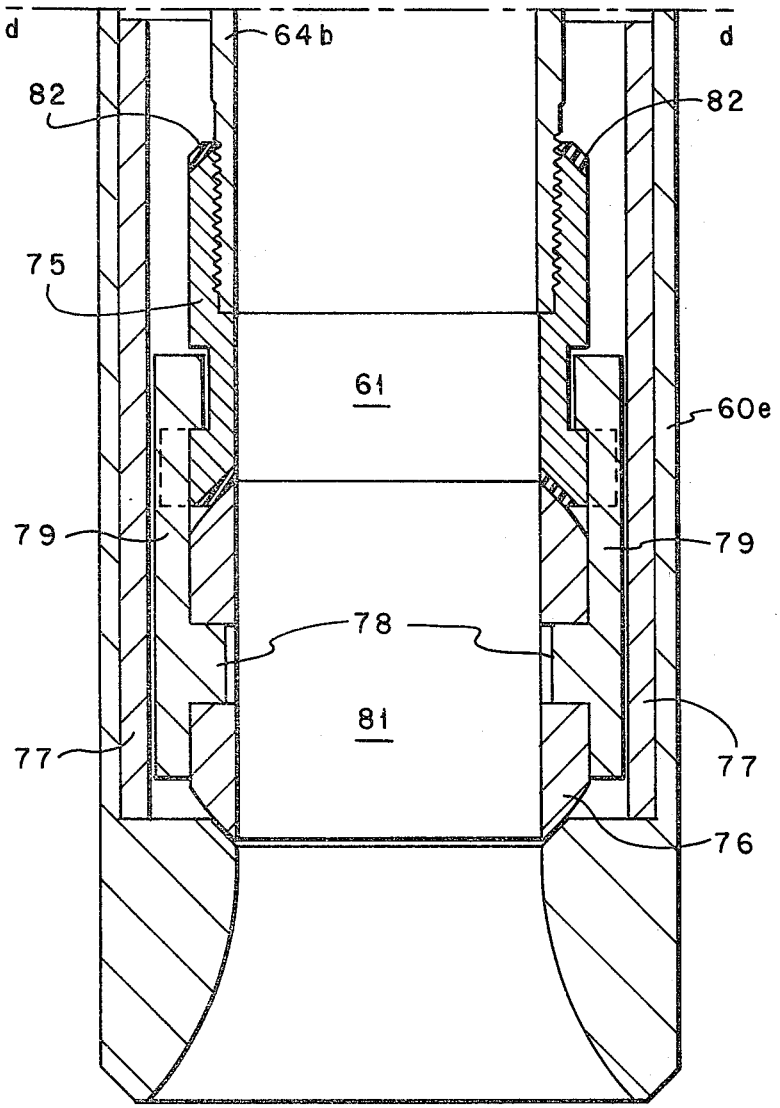

The valve closure means for safety valve 50 includes operating sleeve 64, ball valve seat means 75 and ball 76. The first position of the valve closure means is shown in FIG. 4E in which ball 76 has been rotated to align bore 81 with flow path 61 and thus open valve 50 for flow therethrough. The second position of the valve closure means is shown in FIG. 2D in which bore 81 has been rotated normal to flow path 61 and thus blocking fluid flow through valve 50.

A similar ball valve rotating mechanism is more fully disclosed in U.S. Pat. No. 3,583,442 to W. W. Dollison which is incorporated by reference for all purposes within this application. Although the valve closure means shown herein contains a ball valve, U.S. Pat. No. 3,860,066 to Joseph L. Pearce et al discloses that a longitudinally slidable sleeve such as sleeve 64 can also satisfactorily operate poppet or flapper type valves. Therefore, the present invention is not limited to only ball type safety valves.

A majority of the surface controlled subsurface safety valves presently used in the oil and gas industry have a direct fluid communication path between the control conduit and control fluid chamber within the safety valve. However, such a valve with a single control conduit has a limited depth for installation within a well. Pilot valve means 90 is used to greatly increase the depth at which safety valve 50 can be installed within a well. The present invention allows operating sleeve 64 to shift the valve closure means to its second position blocking fluid flow through valve 50 with minimal resistance from control fluid forces. The present invention allows the closure of valve 50 to be relatively swift. When valve closure is initiated at the well surface, pilot valve means 90 dumps control fluid from chamber 67 into flow path 61. The relatively large volume of control fluid within chamber 67 is not forced back into small diameter conduit means 35 against the forces of hydrostatic pressure, fluid friction, and fluid inertia. These forces combine to slow down the response time for closure of conventional signal conduit safety valves.

Design of Pilot Valve Means 90

Pilot valve means 90 is carried within housing subassembly **60*a* and receives control fluid via lateral port 62. The housing for pilot valve means 90 includes a portion of the wall of subassembly 60*a* and a longitudinal receptacle 87 attached to the inside diameter of subassembly 60*a* and projecting into flow path 61. Receptacle 87 is a segment of a cylinder having different outside diameters which form tapered surface 87*a* therebetween. Various components of pilot valve means 90 are engaged by threads to the interior of bore 91 which extends longitudinally through receptacle 87**.

One end of bore 91 is blocked or sealed by filter housing 92 to prevent control fluids from communicating with flow path 61 through this end of bore 91. Filter housing 92 is a cylindrical body which is engaged by threads 93 to bore 91. Filter means 96 is carried within cavity 97 of filter housing 92. A plurality of ports 98 extends through the wall of housing 92 to allow communication of control fluid from lateral port 62 into cavity 97. Seal rings 94 and 95 are carried on the exterior of filter housing 92 to direct control fluid flow through cavity 97 and filter means 96 disposed therein. Various commercial filters are available for use as filter means 96. The primary requirement is that filter means 96 remove contaminants from the control fluid which could block or restrict control fluid flow through the remaining components of pilot valve means 90.

Guide cylinder 100 is engaged by threads 101 to the interior of bore 91. Seal rings 102, carried on the exterior of guide cylinder 100, divide bore 91 into first chamber 103 and second chamber 104. First chamber 103 receives control fluid from lateral port 62 via filter means 96. The pressure of control fluid within chamber 103 remains essentially equal to the pressure of control fluid at opening 44. A slight difference in pressure, due to filter means 96, may exist when control fluid is flowing into chamber 67 of safety valve 50.

Bore 106 extends longitudinally through the axis of guide cylinder 100. Hollow sleeve 107 is slidably disposed within second chamber 104 adjacent to guide cylinder 100. Nozzle 108 projects longitudinally from end 109 of hollow sleeve 107. Nozzle 108 is slidably disposed within bore 106 of guide cylinder 100 and projects into first chamber 103. Flow passageway 110 extends through nozzle 108. Passageway 110 allows control fluid communication between chamber 103 and the interior of hollow sleeve 107. Elastomeric lip seals 111 are carried within bore 106 and provide means for forming a fluid tight seal between the inside diameter of bore 106 and the exterior of nozzle 108. Seals 102 and 111 cooperate to direct control fluid flow from first chamber 103 through passageway 110 within nozzle 108 to the interior of hollow sleeve 107.

Check valve means 115 is secured within hollow sleeve 107. Valve means 115 is basically an in-line hydraulic relief valve which is opend by a preselected differential pressure. Within this invention, valve means 115 also functions as a check valve to prevent fluid flow from second chamber 104 back into first chamber 103. Valve means 115 is inserted as a unit into hollow sleeve 107. Valve stem and spring guide 120 is attached by threads 124 to the end of hollow sleeve 107 opposite nozzle 108 and secures valve means 115 therein.

Valve means 115 includes a hollow cartridge 116 sized to fit within hollow sleeve 107. Cartridge 116 has opening 118 which is aligned with passageway 110. Seal ring 117 is carried on the end of cartridge 116 and surrounds opening 118. Thus, valve stem 120 can be threadedly engaged with hollow sleeve 107 to firmly engage cartridge 116 with the end of sleeve 107 from which nozzle 108 projects. This engagement results in seal ring 117 directing control fluid flow from passageway 110 into opening 118. Poppet means 119 is disposed within cartridge 116 and engages opening 118 to block fluid flow therethrough. Spring 121 biases or energizes poppet means 119 to block fluid flow until the pressure of control fluid within chamber 103 exceeds a preselected value. When spring 121 is overcome, control fluid can flow from chamber 103 past poppet means 119 and into the interior of hollow sleeve 107. Drilled passageway 122 and ports 123 are provided through valve stem 120 to communicate control fluid between the interior of hollow sleeve 107 and second chamber 104. A plurality of longitudinal slots 113 in the exterior of hollow sleeve 107 allows control fluid communication within chamber 104 and eliminates any difference in control fluid pressure at end 109 of hollow sleeve 107 which might prevent longitudinal movement of hollow sleeve 107 with respect to guide cylinder 100.

Plug means 130 is secured by threads 131 within the end of bore 91 opposite filter housing 92. Valve seat 133 is formed on the end of plug means 130 contained within bore 91. Drilled passageway 132 extends from valve seat 133 along the longitudinal axis of plug means 130 until passageway 132 intersects a plurality of lateral ports 134. Seal means 140 is carried on the exterior of plug means 130 adjacent to threads 131 to limit fluid communication between flow path 61 and bore 91 to drilled passageway 132 and lateral ports 134.

Valve element 135 is attached to the end of valve stem 120 opposite from hollow sleeve 107. Since hollow sleeve 107 and valve stem 120 are attached to each other by threads 124, they slide longitudinally as a single unit within bore 91. The extreme end of valve element 135 is sized to contact valve seat 133 and to block fluid flow through drilled passageway 132. Valve stem 120 also functions as a guide or retainer for spring 136. Spring 136, which is disposed around valve stem 120, abuts both the end of plug means 130 within bore 91 and shoulder 137 on the exterior of valve stem 120 ajacent to hollow sleeve 107. Spring 136 biases valve stem 120 to hold valve element 135 spaced longitudinally from valve seat 133 as shown in FIG. 2B.

For ease of assembly, the end of plug means 130 contained within bore 91 consists of a reduced outside diameter portion **130*a* fitted within cylinder 130*b* and spacer 130*c*. Bore 91 has a reduced inside diameter portion 141 adjacent to the mid portion of plug means 130. A plurality of longitudinal slots 142 is formed in reduced inside diameter portion 141. Matching splines 143 are formed on the exterior of cylinder 130*b* to engage some of the slots 142. As shown in FIG. 3, some slots 142 are open to allow control fluid communication therethrough. Splines 143 engage selected slots 142 to prevent rotation of cylinder 130*b* while plug means 130 is being engaged with threads 131. Reduced outside diameter portion 130*a* can freely rotate within cylinder 130*b* during assembly. Preventing rotation of cylinder 130*b* prevents damage to spring 136 during assembly. Those skilled in the art will readily see alternative means for engaging plug means 130 with bore 91**.

The extreme end of housing subassembly **60*a* extends into the interior of housing subassembly 60*b*. Recess 148 is formed within the inside diameter portion of subassembly 60*b* which is overlapped by the end of subassembly 60*a*. Seal rings 147 are carried on the end of subassembly 60*a* and form a fluid tight barrier with subassembly 60*b*. Port or second opening 149 extends through pilot valve housing means 87 to communicate fluid between second chamber 104 and recess 148. Seal rings 147 block fluid communication between flow path 61 and recess 148. Drilled passageways 68*a* and 68*b* extend between recess 148 and control fluid chamber 67**.

When the pressure of control fluid within first chamber 103 exceeds a preselected value, hollow sleeve 107 and valve stem 120 will slide longitudinally within bore 91 until valve element 135 contacts valve seat 133. This contact blocks fluid communication with flow path 61 via drilled passageway 132. This contact also stops longitudinal movement of hollow sleeve 107 which allows control fluid pressure within first chamber 103 to be increased to an even higher preselected value to overcome spring 121. At this higher control fluid pressure, poppet means 119 will open passageway 110 allowing control fluid to flow from first chamber 103 to second chamber 104 via hollow sleeve 107. From second chamber 104 control fluid can communicate with control chamber 67 via second opening 149, recess 148, and drilled passageways **68*a* and 68*b*. The first position for pilot valve means 90 is defined by valve element 135 contacting valve seat 133. In this first position pilot valve means 90 allows control fluid communication from the well surface to chamber 67**.

Pilot valve means 90 also has a second position defined by valve element 135 being spaced longitudinally from valve seat 133. In this second position, control fluid can communicate from control chamber 67 via passageways **68*a* and 68*b*, recess 148, second opening 149, second chamber 104, drilled passageway 132 and lateral ports 134 to flow path 61. This communication path quickly equalizes fluid pressure between control chamber 67 and flow path 61 to allow resilient means 72 to shift the valve closure means of safety valve 50 to its closed or second position. When pilot valve means 90 is in its second position, check valve means 115 prevents control fluid in first chamber 103 from communicating with flow path 61. Springs 121 and 136 are selected to ensure that pilot valve means 90 is in its first position before check valve means 115** opens.

The first valve means of pilot valve means 90 comprises valve stem 120, valve element 135 and valve seat 133. The second valve means of pilot valve means 90 comprises check valve means 115, hollow sleeve 107, nozzle 108, lip seals 111, and guide cylinder 100.

Operating Sequence

To produce formation fluids through tubing string 31, safety valve 50 must be in its first position allowing fluid flow therethrough. To shift safety valve 50 to its first position, control fluid pressure is directed from manifold 36 to opening 44 via conduit means 35. Control fluid can flow from opening 44 into first chamber 103 via filter means 96. Check valve 115 initially blocks control fluid from leaving first chamber 103. As the pressure within chamber 103 increases, spring 136 is compressed until valve element 135 contacts valve seat 133. This contact blocks fluid communication between bore 91 and flow path 61. Thus, control fluid pressure first shifts pilot valve means 90 to its first position. After contact between valve element 135 and valve seat 133, the pressure of control fluid within chamber 103 increases rapidly until biasing means 121 is overcome to allow control fluid flow from chamber 103 into second chamber 104 via nozzle 108 and poppet means 119. Since bore 132 through plug 130 is now blocked by the first valve means, control fluid pressure within second chamber 104 can only flow into control chamber 67 of safety valve 50 via second opening 149, recess 148 and drilled passageways **68*a* and 68*b*. Control fluid pressure within chamber 67 acts upon piston means 65 to overcome resilient means 72 and to slide operating sleeve 64 longitudinally within safety valve housing means 60. This longitudinal movement rotates ball 76 to align its bore 81 with flow path 61. Thus, increasing control fluid pressure at manifold 36 results in first compressing spring 136, then spring 121 and finally spring 72. After safety valve 50 has been shifted to its first position, movement of operating sleeve 64 and fluid flow into chamber 67 both stop. With no flow of control fluid, spring 121 can return poppet means 119 to engagement with opening 109. However, the increased pressure of control fluid in first chamber 103 maintains valve element 135 in contact with valve seat 133. The difference in pressure between first chamber 103 and second chamber 104 is approximately equal to the force required to overcome spring 121 divided by the seal effective area of poppet means 119 during no control fluid flow conditions with safety valve 50 in its first position. This difference in pressure also holds hollow sleeve 107 spaced longitudinally from guide cylinder 100 to maintain contact between valve element 135 and valve seat 133**.

In order to block formation fluid flow through tubing string 31, safety valve 50 is shifted to its second position by reducing control fluid pressure at manifold 36. As the pressure of control fluid within chamber 103 decreases below a preselected value, spring 136 will disengage valve element 135 from valve seat 133. This disengagement results in opening fluid communication between second chamber 104 and flow path 61 via bore 132 in plug 130. Also, control fluid within chamber 67 can be dumped into flow path 61 via bore 132. This rapidly equalizes the fluid pressure within chamber 67 and flow path 61 allowing resilient means 72 to slide operating sleeve 64 longitudinally and to rotate ball 76. Control fluid pressure within first chamber 103 needs to decrease only enough to allow spring 136 to move hollow sleeve 107 and valve stem 120 a relatively short distance towards guide cylinder 100. A very small amount of control fluid is displaced from chamber 103 back into conduit means 35 during this movement. The required pressure decrease within chamber 103 is less than the required pressure decrease within chamber 67 to close safety valve 50. The volume of fluid displaced from first chamber 103 is significantly less than the volume of fluid displaced from control chamber 67 into flow path 61. Since only a very small amount of control fluid is returned to conduit means 35, safety valve 50 shifts quickly to its second position following a decrease of control fluid pressure within conduit means 35.

Alternative Embodiment

Figure 6:
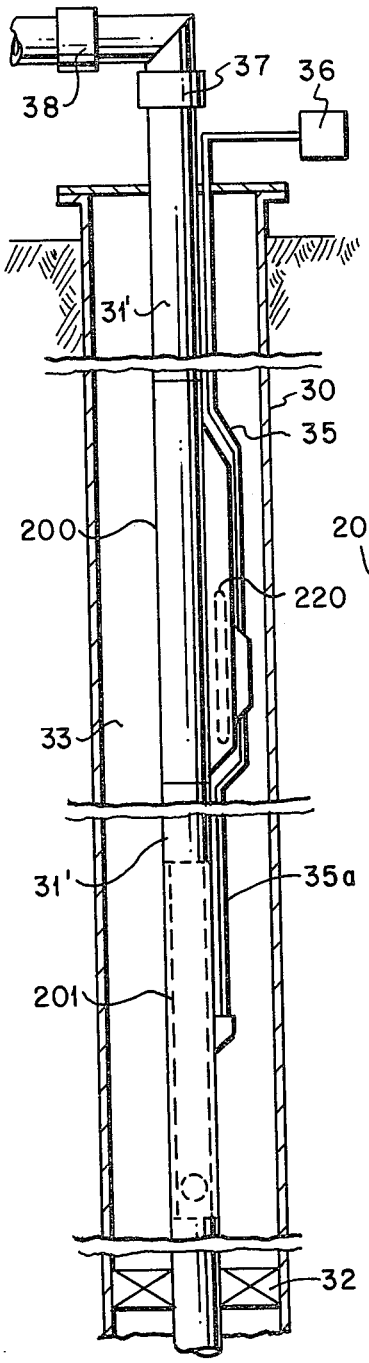
FIG. 6 is a schematic drawing of a well installation having a surface controlled subsurface safety valve incorporating an alternative embodiment of the present invention.
Figure 7A:
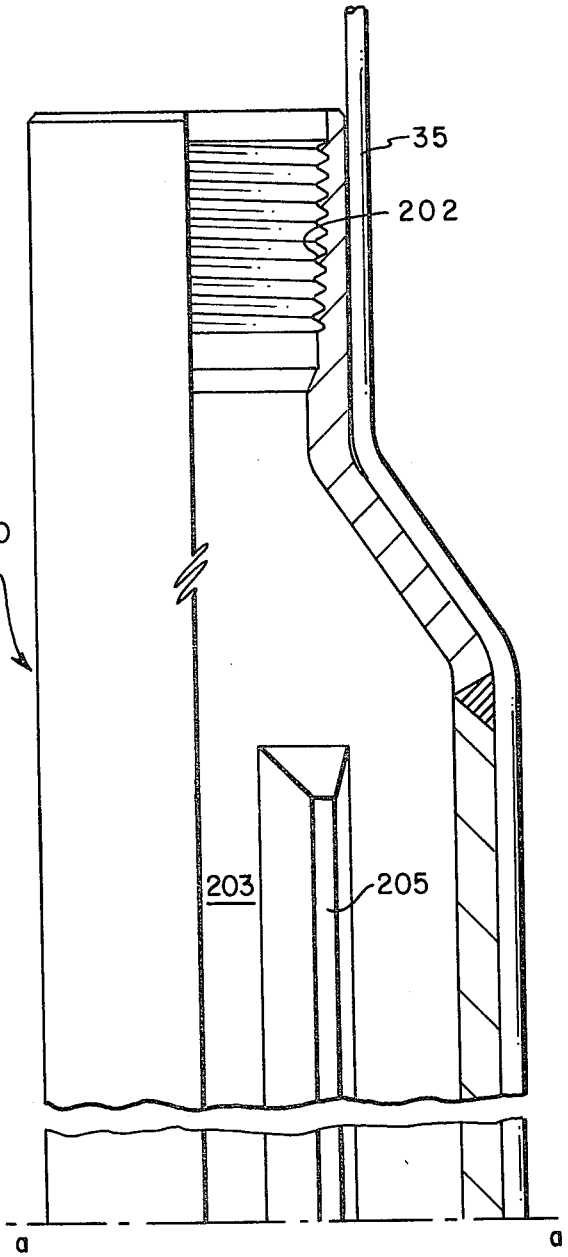
FIGS. 7A–D is a view, partially in section and partially in elevation, of a pilot valve means for use in the well installation of FIG. 6.
Figure 7B:
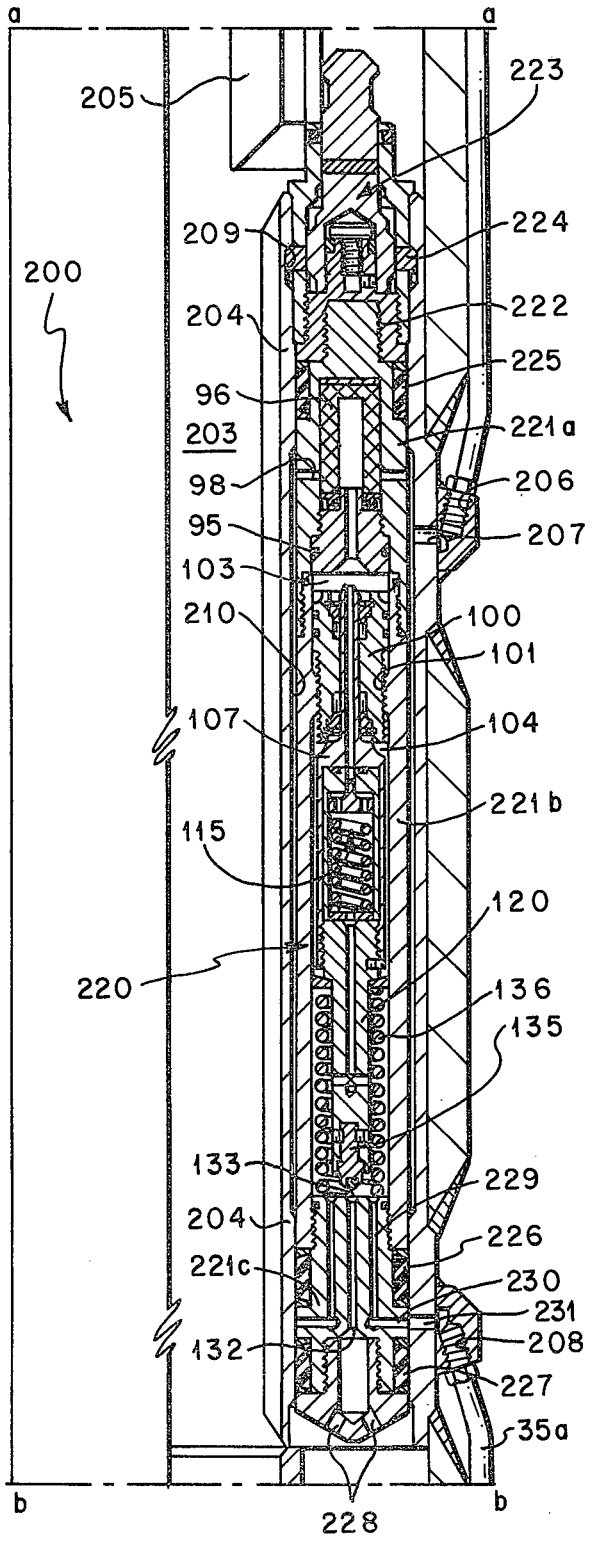
Figure 7C:
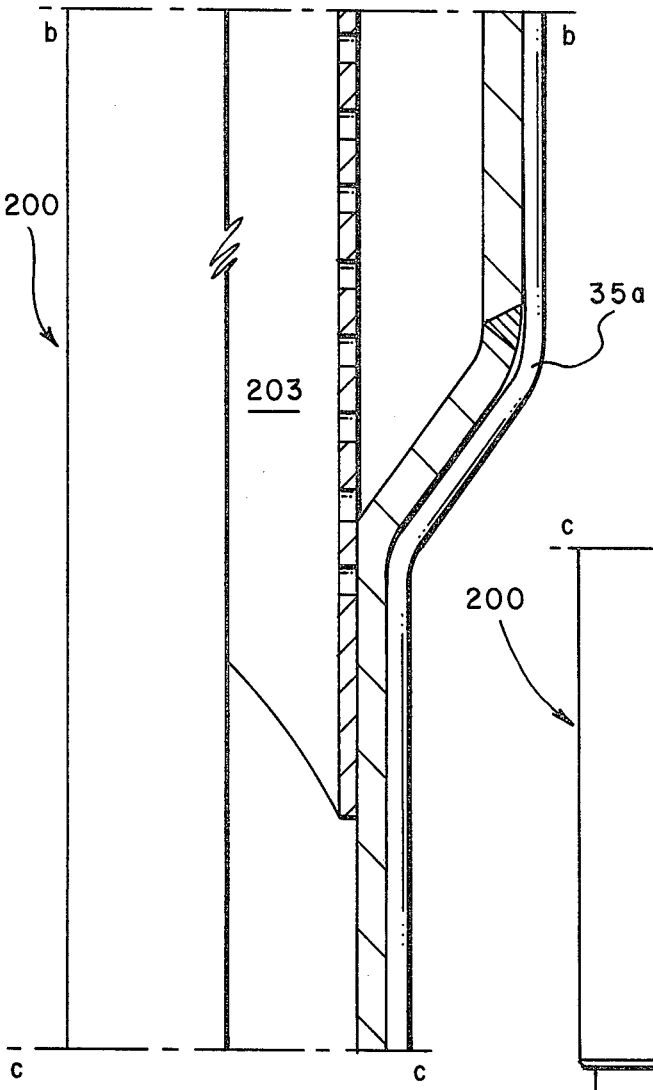
Figure 7D:
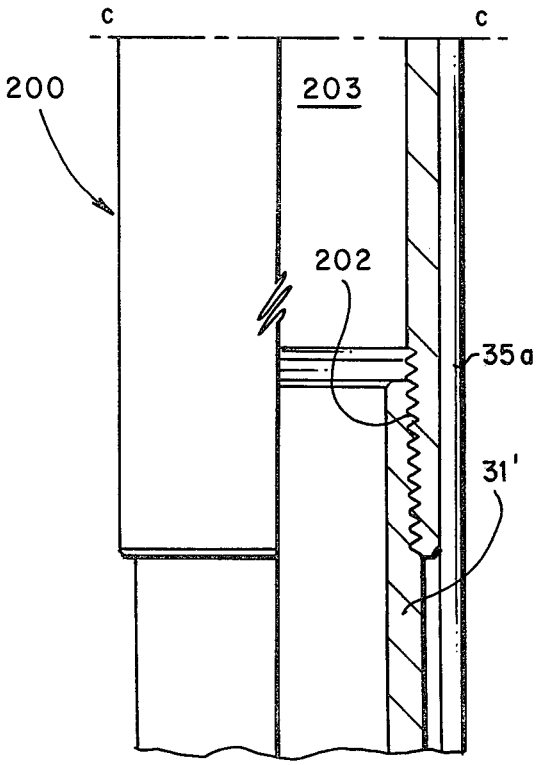

FIG. 6 shows a well installation for using an alternative embodiment of the present invention. FIG. 7 discloses an alternative embodiment of the pilot valve means for use in this well installation. Various components are interchangeable between this embodiment and previously described safety valve 50 and pilot valve means 90. Such components have the same numerical designation.

Tubing string 31' in FIG. 6 contains side pocket mandrel 200 and subsurface safety valve 201. Mandrel 200 has threads 202 on either end for attaching mandrel 200 within tubing string 31'. Mandrel 200 has bore 203 extending longitudinally therethrough and provides a portion of the flow path through tubing string 31'. Side pocket receptacle 204 is contained within mandrel 200 for releasably securing pilot valve means 220 therein. Side pocket receptacle 204 is offset from the longitudinal axis of bore 203. Guide rails 205 are provided to direct insertion and removal of pilot valve means 220 from receptacle 204.

Various surface controlled subsurface safety valves are satisfactory for use as safety valve 201. U.S. Pat. No. 4,119,146 discloses such a safety valve for use with a pilot valve means contained within a side pocket mandrel. The main criteria for selecting safety valve 201 is that control fluid pressure above a preselected value will open safety valve 201. When control fluid decreases below a preselected value, safety valve 201 will close blocking fluid flow through tubing string 31'.

Conduit means 35 extends from the well surface to first threaded opening 206 in mandrel 200. Lateral port 207 directs control fluid from conduit 35 into the interior of receptacle 204. Additionally, conduit means **35*a* is provided to communicate control fluid from second threaded opening 208 to safety valve 201. Mandrel 200 is preferably installed relatively close to safety valve 201**.

Pilot valve means 220 is partially defined by housing means 221 which has three major subassemblies **221*a*, 221*b* and 221*c***. *Housing subassembly 221a* carries filter means 96 disposed within its inside diameter. Threads 222 are provided on the end of housing subassembly **221*a* to attach latch means 223 thereto. Latch means 223 carries dogs 224 which can be radially expanded into groove 209 on the inside diameter of receptacle 204. Dogs 224 and groove 209 cooperate to releasably secure pilot valve means 220 within receptacle 204. Latch means 223** can be operated by conventional wireline and/or pumpdown well servicing tools.

Seal means 225 is carried on the exterior of housing subassembly **221*a* to form a fluid tight barrier with the inside diameter of receptacle 204 when dogs 224 are secured within groove 209. Similar seal means 226 and 227 are carried on the exterior of housing subassembly 221*c*. Receptacle 204 has an enlarged inside diameter portion 210 between seal means 225 and 226 for receiving control fluid from first opening 206. A plurality of lateral ports 98 extends through housing subassembly 221*a* to communicate control fluid between enlarged inside diameter portion 210 and filter means 96. Seal means 95 is provided within the interior of housing means 221 to direct control fluid flow through filter means 96**.

Guide cylinder 100 is secured to the inside diameter of housing subassembly **221*b* by threads 101. Subassembly 221*b* is a hollow cylinder threadedly engaged with subassembly 221*a* at one end and subassembly 221*c* at the other end. Guide cylinder 100 divides the interior of subassembly 221*b* into first chamber 103 and second chamber 104. Control fluid is supplied to first chamber 103 via filter means 96. Hollow sleeve 107, with check valve 115 secured therein by valve stem 120, is disposed within second chamber 104**.

Housing subassembly **221*c* is essentially a plug means threadedly engaged with the end of subassembly 221*b* opposite from latch means 223. Passageway or bore 132 extends longitudinally through subassembly 221*b* to allow fluid communication via openings 228 with flow path 203. Also, passageways 229 and 230 are provided through subassembly 221*c* to communicate with second opening 208 and conduit means 35*a* via lateral port 231. Seal means 226 and 227 are positioned on opposite sides of passageways 230 to prevent undesired fluid communication between conduit 35*a* and flow path 203**.

When pilot valve means 220 is in its second position, check valve 115 blocks control fluid flow from first chamber 103 into second chamber 104 and valve element 135 is held longitudinally spaced from valve seat 133 by biasing means 136. Thus, fluid pressure in conduit 35*a* is equalized with fluid pressure in flow path 203 via openings 228, passageway 132, second chamber 104, passageways 229 and 230, lateral port 231 and opening 208. Safety valve 201 is designed to close when fluid pressure within its control chamber is equalized with fluid pressure in flow path 203.

To open safety valve 201, control fluid pressure is supplied to first chamber 103 via conduit means 35, first opening 206 and filter means 96. As fluid pressure in first chamber 103 increases, spring or biasing means 136 is compressed as hollow sleeve 107 moves longitudinally away from guide cylinder 100. This longitudinally movement results in valve element 135 contacting valve seat 133 blocking fluid flow through passageway 132. Increasing fluid pressure within chamber 103 to an even higher value results in check valve 115 opening to allow control fluid flow from first chamber 103 into second chamber 104. Since passageway 132 is now blocked, control fluid can flow from second chamber 104 via passageways 229 and 230 into conduit means 35*a* to open safety valve 201. Thus, increasing control fluid pressure in conduit means 35 initially shifts pilot valve means 220 to its first position and then opens safety valve 201.

A major difference between pilot valve means 220 and 90 is that pilot valve means 220 can be installed and retrieved independently of safety valve 201. Pilot valve means 90 is a component part of safety valve 50 and can only be installed and retrieved from tubing string 31 with safety valve 50.

The preceding disclosure and description of this invention is illustrative of only two embodiments. Various changes and modifications, apparent to those skilled in the art, can be made without departing from the scope or spirit of the invention which is defined by the following claims.

What is claimed is:

1. A surface controlled subsurface safety valve comprising:

a. safety valve housing means with a fluid flow path therethrough;

b. valve closure means associated with the safety valve housing means and adapted for movement between a first position opening the flow path and a second position closing the flow path;

c. control chamber means adapted to receive control fluid from the well surface and to shift the valve closure means from its second position to its first position when the pressure of fluid within the control chamber is greater than a preselected value;

d. resilient means for urging the valve closure means to shift from its first position to its second position when the pressure of fluid within the control chamber is less than a preselected value;

e. a pilot valve means having a first position allowing communication of control fluid from the well surface to the control chamber when the pressure of control fluid within the pilot valve exceeds a preselected value and blocking fluid communication between the control chamber and the flow path;

f. the pilot valve means having a second position blocking communication of control fluid from the well surface with the control chamber and allowing fluid within the control chamber to communicate with the flow path;

g. the pilot valve means comprising a first valve means and second valve means;

h. the first valve means having a first position blocking fluid communication between the control chamber and the flow path when the valve closure means is in its first position and a second position allowing communication between the control chamber and the flow path;

i. means for biasing the first valve means towards its second position allowing communication of fluids between the control chamber and the flow path;

j. means for biasing the second valve means towards a position blocking communication of control fluid from the well surface through the pilot valve means to the control chamber; and k. control fluid pressure above a first preselected value shifting the first valve means to its first position and control fluid pressure above a second higher preselected value overcoming the biasing means of the second valve means to allow control fluid communication with the control chamber.

2. The surface controlled subsurface valve, as defined in claim 1, further comprising:

a. an opening for receiving control fluid from the well surface via a conduit means;

b. a bore extending through the pilot valve means and communicating fluid between this opening and the control chamber;

c. the first valve means and second valve means disposed within the bore; and d. filter means disposed within the bore between the opening and the second valve means.

3. A surface controlled subsurface safety valve comprising:

a. safety valve housing means with a fluid flow path therethrough;

b. valve closure means associated with the safety valve housing means and adapted for movement between a first position opening the flow path and a second position closing the flow path;

c. control chamber means adapted to receive control fluid from the well surface and to shift the valve closure means from its second position to its first position when the pressure of fluid within the control chamber is greater than a preselected value;

d. resilient means for urging the valve closure means to shift from its first position to its second position when the pressure of fluid within the control chamber is less than a preselected value;

e. a pilot valve means having a first position allowing communication of control fluid from the well surface to the control chamber when the pressure of control fluid within the pilot valve exceeds a preselected value and blocking fluid communication between the control chamber and the flow path;

f. the pilot valve means having a second position blocking communication of control fluid from the well surface with the control chamber and allowing fluid within the control chamber to communicate with the flow path;

g. the pilot valve means comprising a first valve means and second valve means;

h. the first valve means having a first position blocking fluid communication between the control chamber and the flow path when the valve closure means is in its first position and a second position allowing communication between the control chamber and the flow path;

i. means for biasing the first valve means towards its second position allowing communication of fluids between the control chamber and the flow path;

j. means for biasing the second valve means towards a position blocking communication of control fluid from the well surface through the pilot valve means to the control chamber;

k. control fluid pressure above a first preselected value shifting the first valve means to its first position and control fluid pressure above a second higher preselected value overcoming the biasing means of the second valve means to allow control fluid communication with the control chamber;

l. a pilot valve housing means disposed within the safety valve housing means;

m. a first opening through the safety valve housing means and the pilot valve housing means to allow fluid communication between a control fluid conduit exterior to the safety valve housing means and the interior of the pilot valve housing means;

n. the second valve means disposed within the pilot valve housing means spaced longitudinally from the first opening and controlling fluid flow therefrom;

o. the second valve means comprising a guide cylinder secured to the inside diameter of the pilot valve housing means longitudinally spaced from the first opening;

p. the cylinder dividing the interior of the pilot valve housing means into a first chamber, which communicates with the first opening, and a second chamber;

q. a bore extending longitudinally through the cylinder;

r. a hollow sleeve slidably disposed within the second chamber adjacent to the guide cylinder;

s. a nozzle, with a flow passageway therethrough, projecting longitudinally from the end of the sleeve adjacent to the cylinder and extending through the cylinder bore;

t. means for forming a fluid tight seal between the inside diameter of the pilot valve housing means and the outside diameter of the cylinder;

u. means for forming a fluid tight seal between the inside diameter of the cylinder bore and the exterior of the nozzle;

v. the above seal means cooperating to direct fluid flow from the first chamber through the nozzle to the interior of the hollow sleeve;

w. a check valve disposed within the hollow sleeve to block fluid flow through the nozzle;

x. the biasing means for the second valve means energizing the check valve to block fluid flow until the pressure of control fluid at the first opening exceeds a preselected value; and y. port means extending through the hollow sleeve to allow fluid communication between the interior of the hollow sleeve and the second chamber.

4. A surface controlled subsurface safety valve, as defined in claim 3, wherein the first valve means further comprises:

a. a valve stem attached to the hollow sleeve opposite the nozzle;

b. a valve element attached to the extreme end of the valve stem opposite the hollow sleeve;

c. plug means secured within the end of the pilot valve housing means opposite the first opening and having a bore extending therethrough;

d. a valve seat formed on the end of the plug bore within the pilot valve housing means and engageable by the valve element;

e. the plug bore communicating between the interior of the pilot valve housing means and the flow path through the safety valve;

f. the biasing means for the first valve element disposed between the plug and the hollow sleeve; and g. a second opening through the pilot valve housing means for fluid communication with the control chamber of the safety valve.

5. A surface controlled subsurface safety valve, as defined in claim 4, further comprising:

a. filter means disposed within the pilot valve housing means between the first opening and the nozzle; and b. grooves formed in the exterior of the hollow sleeve to prevent formation of a fluid seal restricting longitudinal movement of the sleeve with respect to the guide cylinder.

6. A surface controlled subsurface safety valve, as defined in claim 1, further comprising:

a. a flow conductor connecting the safety valve to the well surface;

b. a receptacle within the flow conductor;

c. latch means for releasably securing the pilot valve means within the receptacle; and d. seal means for forming a fluid tight barrier between the exterior of the pilot valve means and the interior of the receptacle.

7. A pilot valve for alternatively communicating fluid between a control conduit and a control chamber within a safety valve or for communicating fluid between the control chamber and a flow path within the safety valve comprising:

a. a pilot valve housing means;

b. a first opening to allow fluid communication between the pilot valve housing means and the control fluid conduit;

c. a first and second valve means disposed within the pilot valve housing means;

d. the pilot valve having a first position allowing communication of control fluid from the well surface to the control chamber when the pressure of control fluid within the pilot valve exceeds a preselected value and blocking fluid communication between the control chamber and the flow path;

e. the pilot valve having a second position blocking communication of control fluid from the well surface with the control chamber and allowing fluid within the control chamber to communicate with the flow path;

f. the first valve means having a first position blocking fluid communication between the control chamber and the flow path and a second position allowing communication between the control chamber and the flow path;

g. means for biasing the first valve means towards its second position;

h. means for biasing the second valve means towards a position blocking communication of control fluid from the well surface through the pilot valve to the control chamber;

i. the biasing means for the first valve means selected to yield at a control fluid pressure lower than the control fluid pressure at which the biasing means for the second valve means will yield whereby control fluid pressure above a preselected value will shift the first valve element to its first position blocking control fluid communication with the flow path and thereafter overcoming the biasing means for the second valve means to allow control fluid communication with the control chamber;

j. latch means for releasably securing the pilot valve within a well flow conductor; and k. seal means for forming a fluid tight barrier between the exterior of the pilot valve housing means and the flow conductor.

8. A pilot valve for alternatively communicating fluid between a control fluid conduit and a control chamber within a safety valve or for communicating fluid between the control chamber and a flow path within the safety valve comprising:

a. a pilot valve housing means;

b. a first opening to allow fluid communication between the pilot valve housing means and the control fluid conduit;

c. a first and second valve means disposed within the pilot valve housing means;

d. the pilot valve having a first position allowing communication of control fluid from the well surface to the control chamber when the pressure of control fluid within the pilot valve exceeds a preselected value and blocking fluid communication between the control chamber and the flow path;

e. the pilot valve having a second position blocking communication of control fluid from the well surface with the control chamber and allowing fluid within the control chamber to communicate with the flow path;

f. the first valve means having a first position blocking fluid communication between the control chamber and the flow path and a second position allowing communication between the control chamber and the flow path;

g. means for biasing the first valve means towards it second position;

h. means for biasing the second valve means towards a position blocking communication of control fluid from the well surface through the pilot valve to the control chamber;

i. the biasing means for the first valve means selected to yield at a control fluid pressure lower than the control fluid pressure at which the biasing means for the second valve means will yield whereby control fluid pressure above a preselected value will shift the first valve means to its first position blocking control fluid communication with the flow path and thereafter overcoming the biasing means for the second valve means to allow control fluid communication with the control chamber;

j. the second valve means comprising a guide cylinder secured to the inside diameter of the pilot valve housing means longitudinally spaced from the first opening;

k. the cylinder dividing the interior of the pilot valve housing means into a first chamber, which communicates with the first opening, and a second chamber;

l. a bore extending longitudinally through the cylinder;

m. a hollow sleeve slidably disposed within the second chamber adjacent to the guide cylinder;

n. a nozzle, with a flow passageway therethrough, projecting longitudinally from the end of the sleeve adjacent to the cylinder and extending through the cylinder's bore;

o. a check valve disposed within the hollow sleeve and engageable with the flow passage in the nozzle to block fluid flow therethrough; and p. the biasing means for the second valve means holding the check valve engaged with the flow passageway until the pressure of control fluid from the first chamber exceeds a preselected value.

9. A pilot valve, as defined in claim 8, wherein the first valve means comprises:

a. a valve stem attached to the hollow sleeve opposite the nozzle;

b. a valve means attached to the extreme end of the valve stem opposite the hollow sleeve;

c. plug means secured within the end of the pilot valve housing means opposite the first opening and having a bore extending therethrough;

d. a valve seat formed on the end of the plug bore within the pilot valve housing means and engageable by the valve element;

e. the plug bore communicating with the interior of the pilot valve housing means and the flow path through the safety valve; and f. a second opening through the pilot valve housing means for fluid communication with the control chamber of the safety valve.

10. A pilot valve for alternatively communicating fluid between a control fluid conduit and a control chamber within a safety valve or for communicating fluid between the control chamber and flow path within the safety valve comprising:

a. a pilot valve housing means;

b. a first opening to allow fluid communication between the pilot valve housing means and the control fluid conduit;

c. a first and second valve means disposed within the pilot valve housing means;

d. the second valve means comprising a guide cylinder secured to the inside diameter of the pilot valve housing means longitudinally spaced from the first opening;

e. the cylinder dividing the interior of the pilot valve housing means into a first chamber, which communicates with the first opening, and a second chamber;

f. a bore extending longitudinally through the cylinder;

g. a hollow sleeve slidably disposed within the second chamber adjacent to the guide cylinder;

h. a nozzle, with a flow passageway therethrough, projecting longitudinally from the end of the sleeve adjacent to the cylinder and extending through the cylinder's bore;

i. first means for forming a fluid tight seal between the inside diameter of the pilot valve housing means and the outside diameter of the cylinder;

j. second means for forming a fluid tight seal between the inside diameter of the cylinder bore and the exterior of the nozzle;

k. the first and second seal means cooperating to direct fluid flow from the first chamber through the nozzle to the interior of the hollow sleeve;

l. a check valve disposed within the hollow sleeve and engageable with the flow passage in the nozzle to block fluid flow therethrough;

m. the biasing means for the second valve means holding the check valve engaged with the flow passage until the pressure of control fluid from the first opening exceeds a preselected value; and n. port means extending through the hollow sleeve to allow fluid communication between the interior of the hollow sleeve and the second chamber.

11. A pilot valve, as defined in claim 10, wherein the first valve means further comprises:

a. a valve stem attached to the hollow sleeve opposite the nozzle;

b. a valve element attached to the extreme end of the valve stem opposite the hollow sleeve;

c. plug means secured within the end of the pilot valve housing means opposite the first opening and having a bore extending therethrough;

d. a valve seat formed on the end of the plug bore within the pilot valve housing means and engageable by the valve element;

e. the plug bore communicating with the interior of the pilot valve housing means and the flow path through the safety valve;

f. the biasing means for the first valve element disposed between the plug and the hollow sleeve adjacent to the valve stem; and g. a second opening through the pilot valve housing means for fluid communication with the control chamber of the safety valve.

12. A pilot valve, as defined in claim 9 or 10, further comprising:

a. filter means disposed within the pilot valve housing means between the first opening and the nozzle; and b. grooves formed in the exterior of the hollow sleeve to prevent formation of a fluid seal restricting longitudinal movement of the sleeve with respect to the guide cylinder and pilot valve housing means.

13. A pilot valve, as defined in claim 7 or, wherein the pilot valve housing means further comprises:

a. latch means for releasably securing the pilot valve within a well flow conductor; and b. seal means for forming a fluid tight barrier between the exterior of the pilot valve housing means and the flow conductor.

14. A pilot valve, as defined in claim 8 or 10, wherein the pressure of the control fluid in the first chamber is substantially greater than the pressure of control fluid in the second chamber when the pilot valve is in its first position.

15. A pilot valve, as defined in claim 14, wherein the difference in control fluid pressure between first chamber and second chamber approximately equals to the force of the biasing means for the second valve means divided by the seal effective area of the second valve means.

* * * * *